United States Patent [19]

Therkildsen et al.

[11] Patent Number: 4,894,879

[45] Date of Patent: Jan. 23, 1990

[54] HAND TOOL

[76] Inventors: Albert J. Therkildsen, 1820 Maple La., Apt. L69; Ronald A. Kvinge, 619 N. Summit Ave., both of, Kent, Wash. 98031

[21] Appl. No.: 848,797

[22] Filed: Apr. 7, 1986

Related U.S. Application Data

[62] Division of Ser. No. 668,414, Nov. 5, 1984, abandoned.

[51] Int. Cl.[4] ..... B25F 1/00

[52] U.S. Cl. ..... 7/169; 7/138

[58] Field of Search ..... 7/138, 169, 166; 81/125.1, 120.121.1, 180.1

[56] References Cited

U.S. PATENT DOCUMENTS

| | | | |
|---|---|---|---|
| 1,584,422 | 5/1926 | Bate | 7/138 |
| 2,148,573 | 2/1939 | Mulcay | 7/138 |
| 4,198,719 | 4/1980 | Feldpausch | 7/166 |

*Primary Examiner*—James G. Smith

*Attorney, Agent, or Firm*—T. W. Secrest

[57] ABSTRACT

A compound hand tool used in holding a thermostatic expansion valve in a refrigeration unit. The tool comprising an enlarged circular end with an opening extending there through and a finger-like second end opposite the first end. The tool is used to hold the valve in place while an operation is performed upon it.

20 Claims, 3 Drawing Sheets

FIG. 1
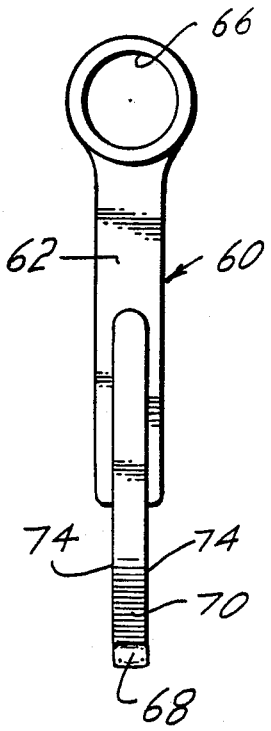
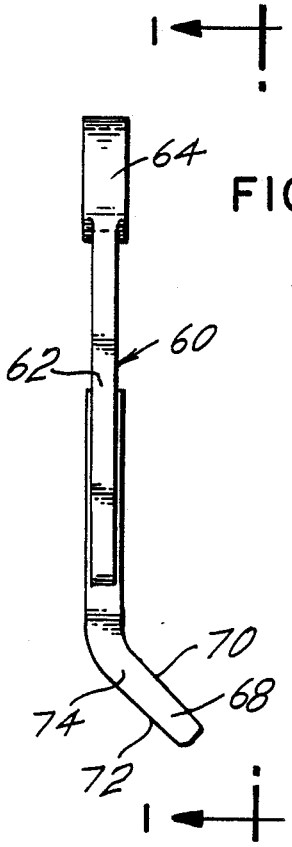
FIG. 2
FIG. 3
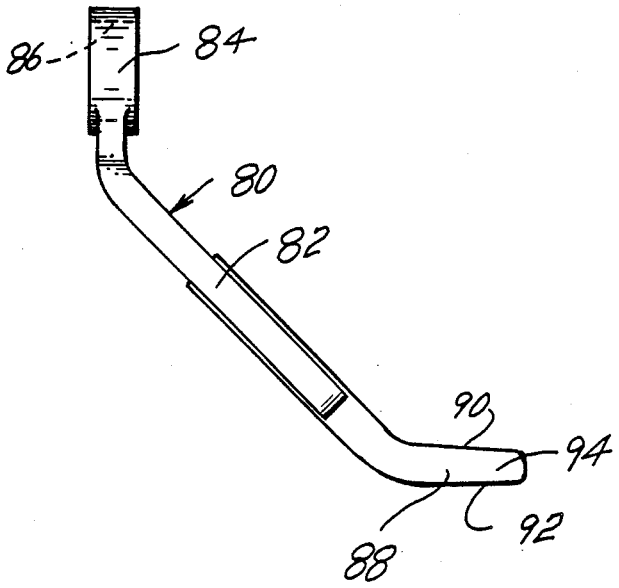

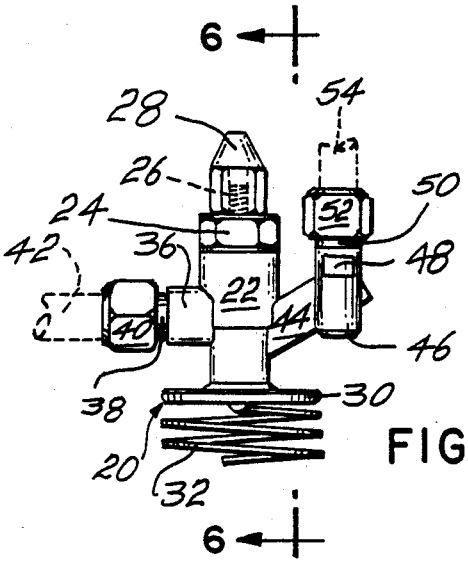
FIG.4
FIG.5
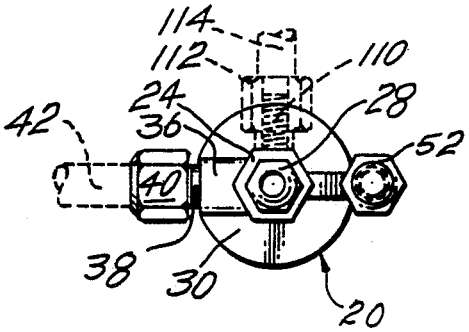
FIG.6
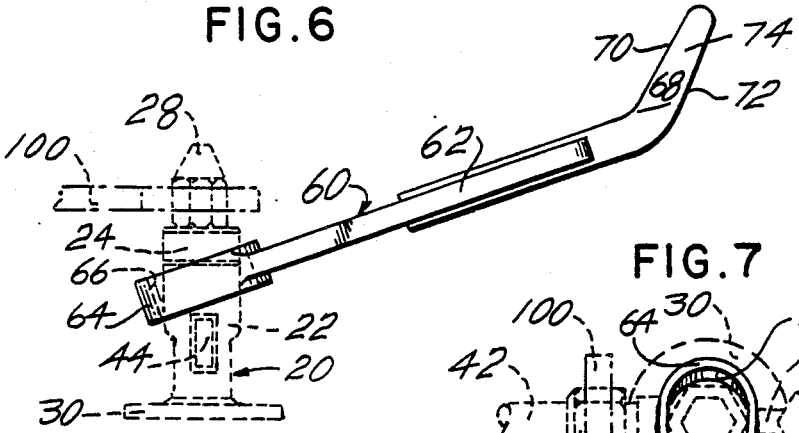
FIG.7
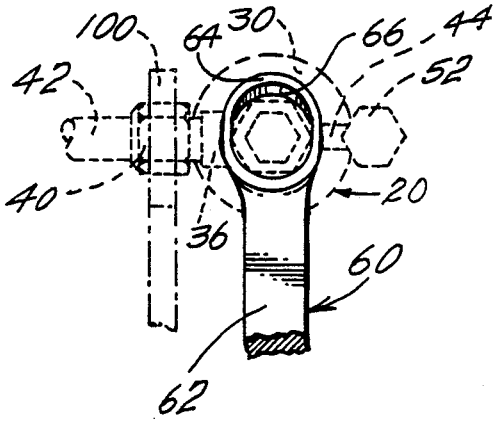

HAND TOOL

This application is a division of application Ser. No. 06/668,414, filed 11/5/84 now abandoned.

THE GENERAL BACKGROUND OF THE INVENTION

This invention is for a hand tool for use with refrigeration equipment. The tool is designed for use with the valve which controls the flow of refrigerant in the refrigeration equipment.

The valve is not connected to a base or a supporting platform as such. The valve connects with two pipes and is suspended by these two pipes or is held in position by these two pipes.

In the process of connecting the valve to the two pipes or in adjusting the valve it is possible to damage the two pipes. Again, the valve is positioned by the two pipes and is not attached to a base or a platform.

The valve comprises a housing and has two connectors for connecting with the two pipes and also has a hexagonal cap. If one of the connectors or the cap is moved or rotated, without bracing the valve, there can be considerable damage to the pipes.

We work with and repair refrigeration equipment. As a result we, frequently, encounter a problem with refrigeration equipment. In our work with refrigeration equipment we remove the hexagonal cap to adjust the valve to a desired setting or we have to replace a defective valve. Over a period of time we have learned to hold the valve with one hand and to adjust the valve with the other hand or to rotate the connectors with the other hand. For example, we can use a screwdriver or a pair of pliers, or a visegrip to wedge between parts of the valve to hold the valve while rotating the connectors or while rotating the hexagonal cap. This is difficult to do but because of the lack of a better tool we have learned to use a screwdriver oro pliers or a visegrip.

A BRIEF DESCRIPTION OF THE INVENTION

This invention is for a hand tool comprising a body or a shank having a first end and also a second end. The first end may be a curved end having a circular passageway. The curved end with the circular passageway can be positioned around the upper end of the valve housing so as to allow a wrench to be placed on the hexagonal cap or hexagonal nut to rotate the same.

The second end is in the form of a finger and can be positioned between the valve housing and an upright pipe so as to be able to use a wrench for rotating a connector between a pipe and the valve.

THE DRAWINGS

In the drawings it is seen that:

FIG. 1 is a top-plan view of the hand tool of this invention.

FIG. 2 is a side-elevational view of a first species of the hand tool.

FIG. 3 is a side-elevational view of a second species of the hand tool.

FIG. 4 is a side-elevational view of a refrigeration valve having two pipe connections, the pipes being in phantom, and a hexagonal cap on the upper end and a Bourdon tube on the lower end.

FIG. 5 is a top-plan view of the refrigeration valve of FIG. 4.

FIG. 6 is a fragmentary side-elevational view, taken on line 6—6 of FIG. 4, with the refrigeration valve in phantom, the hand tool around the upper end of the valve housing and also bearing against the hexagonal shoulders, and a wrench around the hexagonal cap.

FIG. 7 is a fragmentary top-plan view of the valve, in phantom, and with the circular passageway of the curved end of the hand tool around the upper end of the hexagonal shoulders and illustrates the hexagonal cap.

Figure 9:
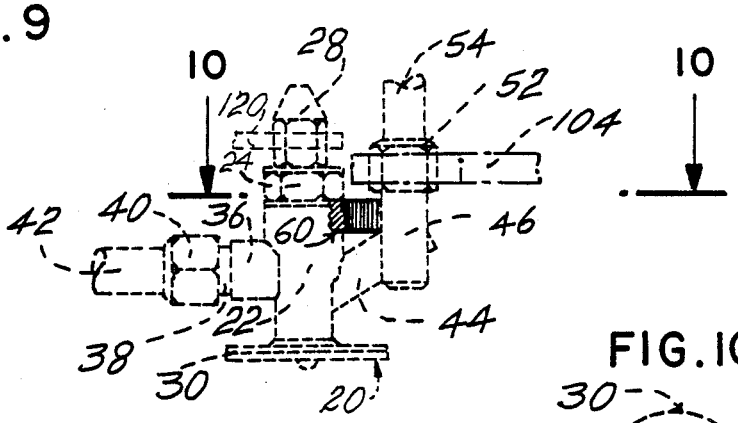
FIG. 9 is a side-elevational view of the valve and illustrates a finger of the hand tool between the valve housing and the upright pipe and a wrench around the other pipe connector of the valve housing.
Figure 10:
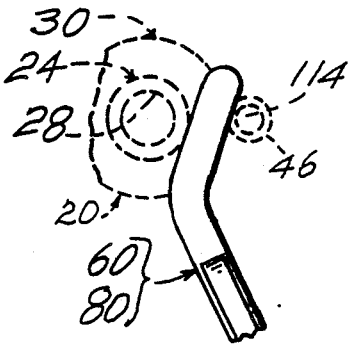

FIG. 10 on an enlarged scale and taken on line 10—10 of FIG. 9 illustrates the finger of the hand tool between the valve housing and the upright pipe so that a pipe connector can be rotated.

THE SPECIFIC DESCRIPTION OF THE INVENTION

This invention is directed to a hand tool for use with a thermostatic expansion valve. The thermostatic expansion valve is a metering device for a refrigerant.

Reference numeral 20 refers to the thermostatic expansion valve. It is seen that there is a valve housing 22. On the upper end of the valve housing 22 there is a set of unitary hexagonal shoulders 24. There projects upwardly out of the valve housing 22 and also the hexagonal shoulders 24 a threaded pipe 26. There is a hexagonal nut cap 28 which screws onto the threaded pipe 26 so as to protect the control unit positioned in the threaded pipe 26.

On the lower end of the valve housing 22 there is an adapter 30. The adapter 30 is positioned between the valve housing 22 and a Bourdon tube 32 or sensing element 32.

In FIG. 4 it is seen that there is an outwardly projecting tube 36 unitary with the valve housing 22. The tube 36 projects left and outwardly from the valve housing 22. On the outer end of the tube 36 there is a threaded end or threaded pipe 38.

A flare nut 40 or a connector 40 is screwed onto the threaded end 38 and connects with a pipe 42. A flare nut 40 is a common connector between a tube 36 and a pipe 42.

In FIG. 4 it is seen that at the right of the valve housing 22 there is a unitary angled tube 44. The angled tube 44 is directed upwardly. The angled tube 44 connects with an upright pipe or tube 46. On the upper end of the upright pipe 46 there are two flat shoulders 48. These flat shoulders 48 are on opposite sides of the upright pipe or tube 46. One of the flat shoulders 48 is seen in FIG. 4.

The upper end of the upright tube 46 is threaded at 50 and is termed a threaded end 50.

A flare nut 52 or a connector 52 screws onto the threaded end 50 and also connects with the pipe 54.

The pipes 42 and 54 are not part of the thermostatic expansion valve 20. The valve 20 connects with the pipes 42 and 54 but the valve 20 is a unit in itself. The valve 20 is a unitary construction comprising the components 22, 24, 30, 32, 36, 38, 44, 46, 48, 50 and 26. These components in conjunction with the valve 20 are an integral structure.

In FIG. 2 there is shown a first species of a hand tool 60 comprising a shank 62 having an enlarged curved end 64 on one end of the shank 62. In the enlarged curved end 64 there is a circular passageway 56. On the other end of the shank 62 there is a finger 68 having a flat inner surface and also a flat outer surface 72. The finger 68 has parallel sides 74 as illustrated in FIG. 1. The approximate angle between the shank 62 and the finger 68 is an inside angle.of about 135°. The enlarged end 64 is a projection of the shank 62 and is along the same longitudinal axis as is the shank 62.

In FIG. 3 there is illustrated a second species of the hand tool 80 having a shank 62 and an enlarged curved end 84 with a passageway 86 in the curved end 84. Also, at the other end of the shank 82 there is a finger 88 having a flat inner surface 90, a flat outer surface 92 and parallel sides 94. There is an inner angle of about 135° between the enlarged curved end 84 and the shank 82. Also, there is an inner angle of about 135° between the shank 82 and the flat inner surface 90 of the finger 88.

I consider that the hand tool 60 and also the hand tool 80 have their advantageous features in regard to the enlarged curved end 64 being an extension of the shank 62 for one purpose and also the enlarged curved end 84 being at an inner angle of about 135° with the shank 82 for another purpose.

In FIG. 6 there is an illustration of the hand tool 60 with the passageway 66 around the upper end of the valve housing 22 and with part of the enlarged curved end 64 bearing against the valve housing 22 and part of the enlarged curved end 64 bearing against the hexagonal shoulders 24. This positions the valve so that a person can apply a wrench 100 around the hexagonal nut or hexagonal cap 28 so as to loosen the nut 28 or tighten the cap 28. The hand tool 60 makes it possible to definitely position the valve 20 with one hand of the operator and the other hand of the operator can manipulate the wrench 100 for working the hexagonal cap 28. In other words the operator can manipulate the hexagonal cap 28 without damaging the connections of the valve 20 to the pipe 42 and to the pipe 54.

In FIG. 7 there is a plan view illustrating the hand tool 80 in an operating relationship to the valve 20 and with the enlarged curved end 84 with the passageway 86 around part of the valve housing 22 and in varying relationship to the valve housing 22 and the other part of the enlarged curved end 84 in varying relationship to the hexagonal shoulders 24 on the upper end of the valve housing 22. Again, this makes it possible for an operator with one hand to use a hand tool 80 for steadying and definitely positioning the hand tool with respect to the valve housing 22 so that the operator with the other hand can use a wrench 100 for manipulating the hexagonal cap 28.

Figure 8:
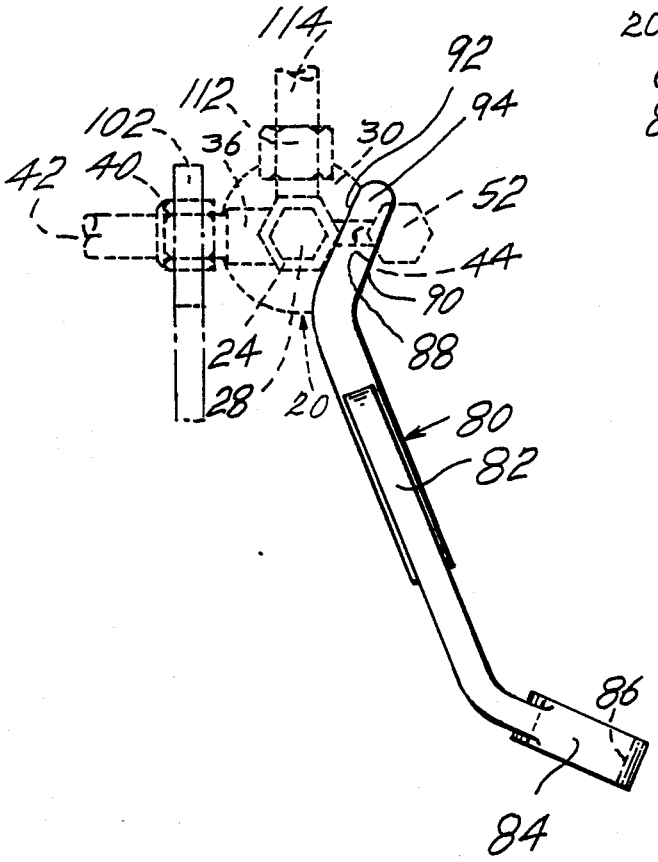
FIG. 8 is a top-plan view of the valve, in phantom, and the second species of the tool with the finger between the valve housing and the upright pipe so that a pipe connector can be rotated by means of a wrench around one of the pipe connectors.

In FIGS. 8, 9 and 10 there is an illustration of the finger 68 or the finger 88 positioned between the upper end of the valve housing 22 and the upright pipe 46 or upright tube 46. The hand tool 60 or the hand tool 80 can be used for positioning the appropriate finger between the valve housing 22 and the upright pipe 46. Again, the hand tool 60 or the hand tool 80 definitely positions the valve 20 and steadies the valve 20 so that the operator, with one hand, can hold a wrench 104 for manipulating the flare nut 52 or for manipulating the flare nut 40.

To repeat, the hand tool 60 makes it possible to definitely position the valve 20, since the valve 20 is not firmly attached to a base, so that the operator with one hand can use the hand tool 60 or the hand tool 80 and with the other hand can use a wrench for manipulating the hexagonal cap 28, or the flare nut 40, or the flare nut 52.

In FIG. 9 there is also illustrated a wrench 120 around the hexagonal cap 28 and the finger 68 between the upper end of the valve housing 22 and the upright pipe 46. The finger 68 positions the valve 20 so as to allow the wrench 120 to rotate the cap 28.

In FIGS. 5 and 8 there is illustrated a modification of the thermostatic expansion valve 20. It is seen that on the valve housing 22 that there is an outwardly directed tube 110 which is threaded on its outer part. The tube 110 is a third tube and is a unitary part of the valve. The outwardly directed tube 110 is threaded for receiving a flare nut 112. The flare nut 112 interconnects the threaded outwardly directed tube 110 and also tube 114. Again, the hand tool 60 or the hand tool 80 can be used for definitely positioning the valve 20 so that the flare nut 112 can be manipulated.

RESUMÉ

The thermostatic expansion valve 20 is suspended by means of connecting pipes such as pipes 42 and 54 and, when appropriate, pipe 114. The valve 20 is not attached to a base and while manipulating the nuts and caps associated with the valve it is necessary to definitely position the valve so as to not harm the connecting pipes 42, 54 and 114.

On the valve 20 are two or three flare nuts 40, 52, 112 or cap 28.

The hand tools 60 and 80 each have an enlarged first end with a passageway and also a second end with a finger.

The operator can place the enlarged end with the passageway around the upper end of the valve housing 22 so that part of the enlarged end bears against the upper part of the valve housing 22 and part of the enlarged end also bears against the hexagonal shoulders 24 on the upper end. While the operator is holding the hand tool with one hand to position the valve 20 the operator can hold a wrench in the other hand to manipulate flare nuts 40, 52 and 112 or the cap 28.

Another way to operator may use the hand tool 60 or the hand tool 80 is for the operator to hold the hand tool and place the finger between the upper part of the valve housing 22 and the upright tube 46 so as to definitely position the valve. Then the operator with the other hand can use a wrench to manipulate the flare nuts 40, 52, 112 or the cap 28.

With this invention it is seen that we have provided a tool for definitely and firmly positioning a suspended valve while working on the valve and this tool makes it possible to work on the valve without harming the valve or damaging the valve.

Also, it is seen that we have provided a unitary tool which on one end is adapted for holding the valve so that certain features of the valve can be worked and the other end is adapted for leveaging the valve so that certain features of the valve can be worked.

Further, it is seen that we have provided tools which can be readily griped and held by an artisan while definitely positioning a valve.

A further advantage of this tool is that there is no maintenance. With a properly constructed tool and used for positioning a valve it is conceivable that the tool will never break or be harmed.

Also, this tool is relatively inexpensive to manufacture as it is of a straight forward construction.

An additional feature of this tool is that it can be readily stored in a tool box or it can be readily carried in a carrier attached to a belt of a workman.

A Patent Search was made preparatory to the preparation of this Patent Application. This Patent Search revealed two United States Patents which are not closely related to the subject invention. These two United States Patents are:

| Name | U.S. Pat. No. | Issuing Date |
|---|---|---|
| Taylor | 2,320,679 | 1 June 1943 |
| Herdman | 1,828,142 | 20 October 1931 |

The Patent to Taylor discloses a bolt rotating tool having a beveled end 20 for preliminary rotation of the bolt and a head 21 for the final tightening of the bolt.

The Patent to Herdaman illustrates a combination drift pin and having a pin end 7 on one end and a wrench head 6 on the other end.

35 U.S.C. 101 states: "Whoever invents or discovers any new and useful procss, machine, manufacture, or composition of matter, or any new and useful improvement thereof, may obtain a patent therefore, subject to the conditions and requirements of this title."

35 U.S.C. 103 states: "A patent may not be obtained though the invention is not identically disclosed or described as set forth in section 102 of this title, if the differences between the subject matter sought to be patented and the prior art are such that the subject matter as a whole would have been obvious at the time the invention was made to a person having ordinary skill in the art to which said subject matter pertains. Patentability shall not be negatived by the manner in which the invnetion was made. July 19, 1952, c. 950, §1,66Stat. 798."

It is considered that the invention is new and unobvious in that the Patent Search did not show such tool and did not show a tool similar to the tool of this Patent Application. A workman can use a screwdriver, pliers, a visegrip or the like to hold a thermostatic expansion valve while working on it. However, a screwdriver, pliers or a visegrip are different than the subject invention.

Also, it is considered that this invention is useful in that it can be used for definitely positioning the valve while working on the valve and therefore lessens the possibility of damaging the valve or the pipes connecting with the valve or the connector means for connecting the pipes to the valve while working on the valve.

From the foregoing and having presented our invention what we claim is:

1. A unitary tool comprising:
a. a shank;
b. said shank having a first end and a second end;
c. said first end being enlarged as compared to the width of said shank;
d. a passageway in said first end;
e. said passageway having an interior wall;
f. said second end being a finger;
g. said finger being reduced in width as compared to the width of the shank and enlarged in thickness as compared to the thickness of the shank; and,
h. said finger extends onto said shank to have a thicker central area in said shank than that part of said shank near said first end.

2. A hand tool according to claim 1 and comprising:
a. said shank and said second end being at an angle with each other; and,
b. said angle being greater than 90° and less than 180°.

3. A hand tool according to claim 1 and comprising:
a. said shank and said second end being at an angle with each other; and,
b. said angle being about 135°.

4. A hand tool according to claim 1 and comprising:
a. said shank and said first end being at an angle with each other; and,
b. said angle being greater than 90° and less than 180°.

5. A tool according to claim 1 and comprising:
a. said shank and said first end being at an angle with each other; and,
b. said angle being about 135°.

6. A tool according to claim 4 and comprising:
a. said shank and said second end being at a second angle with respect to each other; and,
b. said second angle being greater than 90° and less than 180°.

7. A tool according to claim 5 and comprising:
a. said shank and said second end being at a second angle with respect to each other; and,
b. said angle being about 135°.

8. A tool according to claim 6 and comprising:
a. the angle between said first end and said second end being greater than 60° and less than 180°.

9. A tool according to claim 7 and comprising:
a. the angle between said first end and said second end being about 90°.

10. A tool according to claim 1 and comprising:
a. said first end being enlarged; and,
b. said passageway being a circular passageway.

11. A unitary tool according to claim 1 and comprising:
a. said finger on its outer end being curved and rounded; and,
b. said tool being applicable for leveraging purposes.

12. A unitary tool according to claim 2 and comprising:
a. said finger on its outer end being curved and rounded; and,
b. said tool being applicable for leveraging purposes.

13. A unitary tool according to claim 3 and comprising:
a. said finger on its outer end being curved and rounded; and,
b. said tool being applicable for leveraging purposes.

14. A unitary tool according to claim 4 and comprising:
a. said finger on its outer end being curved and rounded; and,
b. said tool being applicable for leveraging purposes.

15. A unitary tool according to claim 5 and comprising:
a. said finger on its outer end being curved and rounded; and,
b. said tool being applicable for leveraging purposes.

16. A unitary tool according to claim 6 and comprising:
a. said finger on its outer end being curved and rounded; and,
b. said tool being applicable for leveraging purposes.

17. A unitary tool according to claim 7 and comprising:

a. said finger on its outer end being curved and rounded; and, b. said tool being applicable for leveraging purposes.

18. A unitary tool according to claim 8 and comprising:

a. said finger on its outer end being curved and rounded; and, b. said tool being applicable for leveraging purposes.

19. A unitary tool according to claim 9 and comprising:

a. said finger on its outer end being curved and rounded; and, b. said tool being applicable for leveraging purposes.

20. A unitary tool according to claim 10 and comprising:

a. said finger on its outer end being curved and rounded; and, b. said tool being applicable for leveraging purposes.

* * * * *